US006662701B2

(12) United States Patent
Grosch et al.

(10) Patent No.: US 6,662,701 B2
(45) Date of Patent: Dec. 16, 2003

(54) DELIVERY SYSTEM FOR A WARHEAD WITH AN ORIENTATION DEVICE FOR NEUTRALIZING MINES

(75) Inventors: Hermann Grosch, Nienhagen (DE); Axel Kaspari, Lüneburg (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 0 days.

(21) Appl. No.: 10/253,611

(22) Filed: Sep. 25, 2002

(65) Prior Publication Data

US 2003/0126979 A1 Jul. 10, 2003

(30) Foreign Application Priority Data

Sep. 27, 2001 (DE) ..... 101 47 837

(51) Int. Cl.[7] ..... B64D 1/04
(52) U.S. Cl. ..... 89/1.13
(58) Field of Search ..... 89/1.13; 244/3.11, 244/3.13, 3.22; 102/384; 124/22

(56) References Cited

U.S. PATENT DOCUMENTS

| | | | | | |
|---|---|---|---|---|---|
| 3,116,039 | A | * | 12/1963 | Goldberg | 244/3.11 |
| 3,743,216 | A | * | 7/1973 | Salonimer | 244/3.16 |
| 3,860,199 | A | * | 1/1975 | Dunne | 244/3.13 |
| 3,924,600 | A | * | 12/1975 | Luebkeman | 124/36 |
| 3,971,357 | A | * | 7/1976 | LaPorte et al. | 124/8 |
| 3,974,383 | A | * | 8/1976 | Chapman | 250/342 |
| 3,998,406 | A | * | 12/1976 | Smith et al. | 244/3.14 |
| 4,143,835 | A | * | 3/1979 | Jennings et al. | 244/3.11 |
| 4,176,814 | A | | 12/1979 | Albrektsson et al. | |
| 4,290,364 | A | * | 9/1981 | Weidenhagen et al. | 102/384 |
| 4,300,736 | A | * | 11/1981 | Miles | 244/3.13 |
| 4,406,430 | A | * | 9/1983 | Krammer et al. | 244/3.13 |
| 4,407,465 | A | * | 10/1983 | Meyerhoff | 244/3.16 |
| 4,408,537 | A | * | 10/1983 | Fortier | 102/395 |
| 4,431,147 | A | | 2/1984 | Paley | |
| 4,624,424 | A | * | 11/1986 | Pinson | 244/3.21 |
| 4,676,455 | A | * | 6/1987 | Diehl et al. | 244/3.13 |
| 4,678,143 | A | * | 7/1987 | Griffin | 244/63 |
| 4,901,946 | A | * | 2/1990 | Arnaud et al. | 244/3.13 |
| 5,011,097 | A | * | 4/1991 | Travor et al. | 244/3.21 |
| 5,102,065 | A | * | 4/1992 | Couderc et al. | 244/3.11 |
| 5,259,567 | A | * | 11/1993 | Jano et al. | 244/3.11 |
| 5,350,134 | A | * | 9/1994 | Crawford | 244/3.16 |
| 5,458,041 | A | * | 10/1995 | Sun et al. | 89/1.11 |
| 5,467,940 | A | * | 11/1995 | Steuer | 244/3.11 |
| 5,601,255 | A | * | 2/1997 | Romer et al. | 244/3.13 |
| 5,647,559 | A | * | 7/1997 | Romer et al. | 244/3.13 |
| 5,695,152 | A | * | 12/1997 | Levy | 244/3.13 |
| 5,831,724 | A | * | 11/1998 | Cordes | 356/141.1 |
| 5,988,038 | A | * | 11/1999 | Feintuch | 89/1.13 |
| 6,062,207 | A | * | 5/2000 | Underhill | 124/8 |
| 6,422,507 | B1 | * | 7/2002 | Lipeles | 244/3.13 |

FOREIGN PATENT DOCUMENTS

| | | |
|---|---|---|
| DE | 27 14 688 C2 | 10/1977 |
| DE | 40 35 325 A1 | 5/1992 |
| DE | 41 28 313 C2 | 3/1993 |
| WO | WO 01/16547 A2 | 3/2001 |

OTHER PUBLICATIONS

German Office Action dated Jul. 15, 2002.
European Search Report dated Nov. 26, 2002.

* cited by examiner

*Primary Examiner*—Charles T. Jordan
*Assistant Examiner*—Jordan Lofdahl
(74) *Attorney, Agent, or Firm*—Griffin & Szipl, PC

(57) ABSTRACT

A delivery system (20) for a warhead (3) for neutralization of mines, having an orientation device. The fragmentation warhead (3) is triggered over a visible mine or, over the position of a mine that is optically marked and/or the coordinates of which are known. The triggering of warhead (3) destroys a mine up to a depth of 30 centimeters below the surface. A throwing system with controllable spring tension energy is employed, which has, when compared with a conventional mortar, a higher quality of reproducibility in its starting speed, smaller starting mistakes by means of precise roller bearing guides (6) during the acceleration phase, and temperature independence due to the measuring the energy of the springs (1) during the tensioning process by electric motors. Three microreaction drive mechanisms (15) are provided to correct the flight path, along with a sensor (14) that measures flight path deviation.

30 Claims, 3 Drawing Sheets

Fig. 5
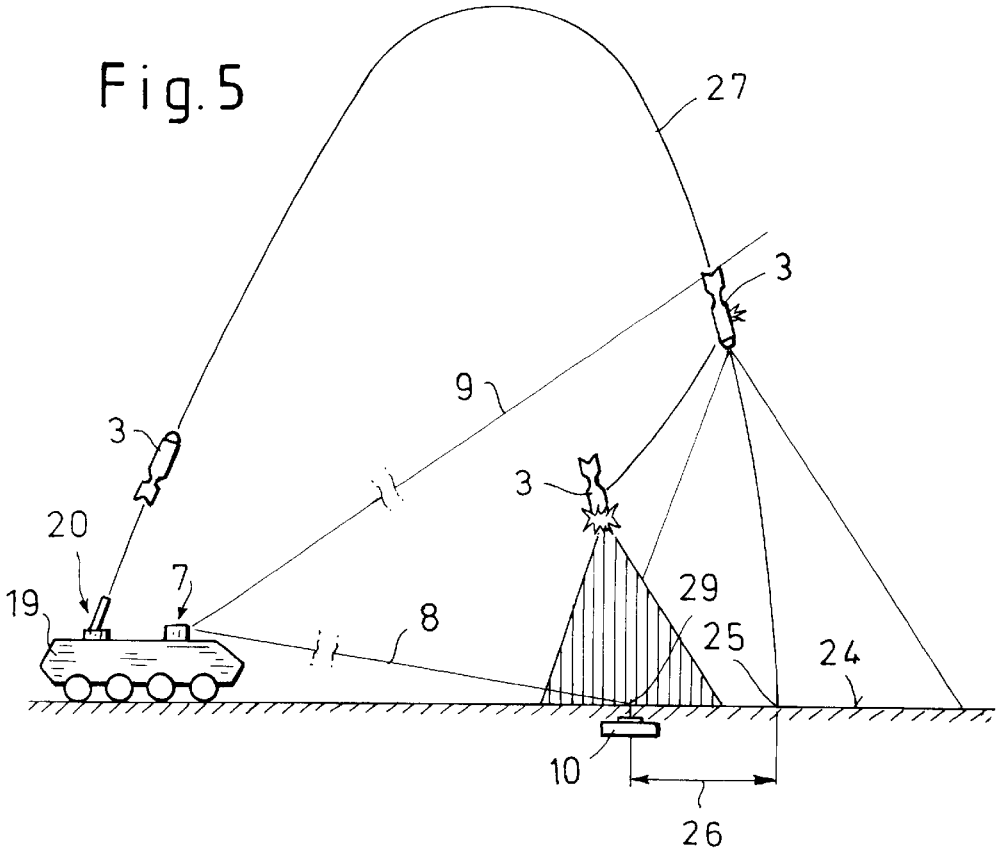
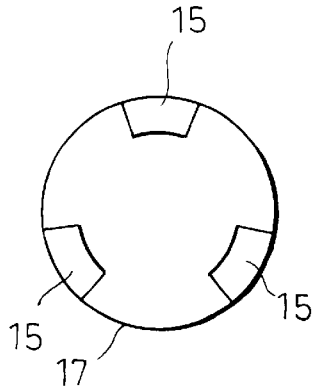
Fig. 6
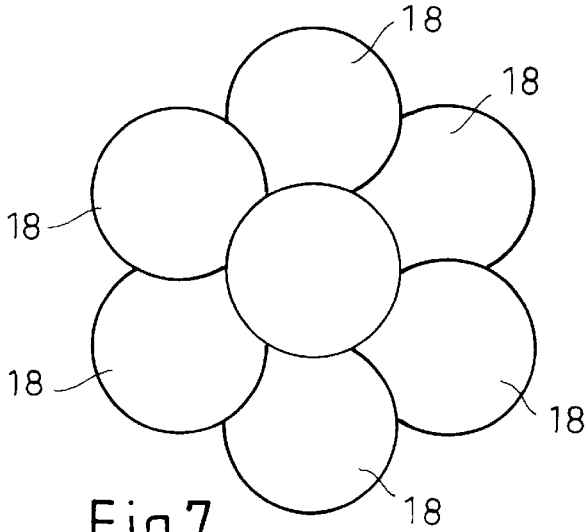
Fig. 7

DELIVERY SYSTEM FOR A WARHEAD WITH AN ORIENTATION DEVICE FOR NEUTRALIZING MINES

FIELD OF THE INVENTION

The invention relates to a system for delivering a warhead into a target zone in order to neutralize mines. The invention relates particularly to a system for delivering a warhead into a target zone, wherein deviation of a flight path of the warhead is correctable by an orientation device.

BACKGROUND OF THE INVENTION

Mines present a particular threat for all combatants in military conflicts. This threat results from a multiplicity of differing activation and attachment mechanisms, construction types and manner of laying the mines, such as that of smart mines or also dump mines. These properties are also the causes for manipulation of laid mines resulting in an unacceptable danger to personnel. With known methods of neutralizing mines, one must always count on the fact that the mine will trigger. Therefore, neutralizing must be carried out by means of technical measures so that personnel are not in danger. It is particularly problematic to neutralize mines under the surface of the ground, when the type and condition of the mines is generally not known.

Known individual mines have been, up until now, cleared overwhelmingly pyrotechnically. If a mine lies in the open, a hollow charge is positioned next to the mine, so that the blast of the hollow charge goes into the explosive. A more simple method consists of laying down a percussive charge that destroys the mine by ignition transmission and/or mechanically. Both of these methods have the disadvantage that the mine can produce significant damage when triggered, particularly when it lies in an urban area.

Methods of making mines secure enough to handle so that they can be picked up and exploded in a secure place consist of applying a quick hardening foam for securing of the mine exploder or by means of cooling with liquid helium in order to block the trigger mechanism.

In order to neutralize mines from a greater distance, on-board weapons, such as, for example, machine guns are used. These weapons destroy the mine mechanically or ignite it by means of the triggering device. All measures for neutralizing mines that must be carried out by a mine sweeper in direct proximity to a mine present unacceptable potential for danger.

Therefore, most methods with sufficient reliability are only applicable to open lying mines. With buried mines, neither the type, condition, nor state of installation and exact position can be determined reliably. Explosions with percussive or hollow charges are ineffective if the presumed position of the mine does not agree with its actual state.

Neutralization of a mine from a secure distance by fire can lead to the damaging of the mine that then no longer allows approach of a mine sweeper. Firing on covered, laid mines therefore does not merit consideration. Even when the mine position is optically marked, the fire angle from a motor vehicle is unsuitable to such a degree that in many cases the length of penetration in the ground is too great.

It is therefore an object of the present invention to provide a system for delivering a warhead in a target zone with an orientation device, which meets the following demands:

(1) The system should allow soldiers in armored vehicles to clear known mines that are laid opened or covered.

(2) The system should provide secure neutralization of mines from a distance of from 10–15 meters from the vehicle. Neutralization should be accomplished so that the crew remains in the vehicle during the entire neutralizing process.

(3) Neutralization should be achieved with high reliability (greater than 95%). It is desirable that the mine not be triggered during the neutralizing process.

(4) All types of mines should be capable of being neutralized (smart mines, dump mines, AT-mines, AP-mines, off-route mines, particularly mines laid open or under the surface of the ground).

(5) The system should be designed as an armament kit that does not give away the signature of the vehicle. The vehicle must find itself in its original condition after dissembling of the armament kit.

(6) The system must have a high degree of automization, in order to largely take the load off of manning by the crew.

(7) The system must be able to function on mines or markers visually identified by the crew, as well as on positions that are known only by their coordinates.

(8) The system must additionally be capable of combating placements of the opponent in proximity so precisely that secondary effects are largely avoided.

(9) The system should be useable in all weather and climate conditions.

SUMMARY OF THE INVENTION

In accordance with the above objects, the present invention provides a system for delivering a warhead to a target region, comprising (a) a fragmentation warhead; (b) a throwing system arranged to throw the fragmentation warhead to a detonation point, having a controllable energy output to achieve a preselectable starting speed; (c) an orientation device disposed on the fragmentation warhead to correct deviation of a flight path of the fragmentation warhead before reaching the detonation point; and (d) a laser illuminator arranged to activate the orientation device, if deviation is present in the flight path of the fragmentation warhead.

In accordance with a further embodiment of the present invention, the throwing system comprises a spring throwing system, having one or more springs, and one or more electric motors arranged to tension the springs and control the energy of the springs to achieve the preselectable starting speed.

In accordance with a still further embodiment, a control device is provided for controlling the tension in the springs with the electric motors.

In accordance with yet further embodiments, the control device comprises force elements arranged to measure the force in the springs, or current sensors operably connected to the power supply of the electric motors.

In accordance with another embodiment, the throwing system further comprises a receptacle operably connected to the one or more springs and configured to contain the fragmentation warhead, a roller guide arranged to slidably receive the receptacle.

In yet another embodiment, a first laser illuminator is provided for producing a first laser beam to illuminate a mine or surface position. The first laser beam is manually or automatically directable to a detected mine.

Preferrably, the laser illuminator produces a second, coded, fan-shaped laser beam, wherein an azimuth angle of a center line of the fan is greater than an azimuth angle of the first illumination laser, and an elevation angle of the center line of the fan is greater than an elevation angle of the illumination laser by a given value, so that the beam fan is positioned at a substantially constant preselected distance over an illumination position of the illumination laser.

In another embodiment, a laser position detector is disposed on the front side of the fragmentation warhead, and a laser detector is disposed on the stern side of the fragmentation warhead, having a decoding device for detecting the second, fan-shaped laser beam.

In a further embodiment, a plurality of microreaction drive mechanisms are oriented evenly spaced around a periphery of the fragmentation warhead, and a trigger mechanism is operably connected to the microreaction drive mechanisms. Preferably, three microreaction drive mechanisms are provided equally spaced around a periphery of the fragmentation warhead, the microreaction drive mechanisms being triggerable singly or in pairs.

A still further embodiment of the present invention provides a method for neutralizing a mine, comprising the steps of (a) providing the system for delivering a warhead to a target region, discussed above, (b) illuminating a target with the laser illuminator; (c) throwing the fragmentation warhead at said preselectable starting speed toward said target; and (d) activating the orientation device, if a deviation is present in the flight path.

The basic principle of the projection system according to the present invention is characterized in that a fragmentation warhead is triggered precisely over a visualized mine, or, if the mine is laid invisibly under the surface of the ground, over its position, which is either optically marked or for which the coordinates are known. The triggering of the fragmenting warhead takes place so that every mine of up to 30 centimeters under the top surface of the ground is destroyed by means of the fragments.

The effect of fragments leads, as a general rule, to the triggering of mines with mechanical triggers. With mines with electrical triggers, orientation mines, among others, triggering does not take place because of the trigger type. These mines are, however, so destroyed that a later, uncontrolled triggering is ruled out. The explosive itself does not cause any direct danger.

In order to realize this, in principle, simple method of operation, several technical demands must be met of the fragmentary warhead:

(1) The fragment concentration must be so high that the trigger of the mine is struck and destroyed with certainty.

(2) The penetration performance of the fragments must be so high that even after passing through 25–30 centimeters of earth, sufficient kinetic energy is present to destroy the trigger assembly.

In order to meet these demands, the fragmentation charge has a fragment density of about 0.2 fragments per square centimeter. With the fragment mass necessary for penetration, the fragmentation warhead achieves this fragment density in a circular surface of about 1 meter in diameter. In order to achieve the desired effect, the mine to be destroyed must therefore find itself within this circle.

In order to deliver an effective body over a distance of from about 20–70 meters so that it lands at a predetermined point on the ground at an angle of from less than 70 degrees, the mortar principle is applicable. The allowable deviation of the target flight path, when, for example, a 38 cm mine is to be completely hit, cannot be more than 31 cm. This exactitude cannot be achieved with a mortar with pyrotechnic propulsion.

In order to achieve the necessary exactitude, two measures are provided:

(1) Instead of a pyrotechnic mortar for delivering the fragmentary warhead, a throwing system with a controlled spring tension energy is used, which has (a) higher quality of reproducibility of departure velocity compared with a comparably geometrically dimensioned mortar, (b) less launch mistakes by means of a precise roller bearing guide during the acceleration phase, and (c) substantial temperature independence by measuring the energy of the spring during the electromotive tensioning process.

(2) The warhead is provided with two microreaction drive mechanisms, which can correct the flight path within several meters before arriving at the detonation point. A sensor that measures the deviation of the flight path controls this correction.

The mechanism of neutralizing is dependent on mechanically destroying mines through action of fragments so that they no longer present any danger. The advantage of this process resides in that it is independent of the size, construction, and trigger mechanism, as well as the manner of laying the mine (whether above or underneath the surface of the ground) to thereby achieve a high probability of neutralization (even against smart mines).

The combination of a highly precise mechanical throwing system and a device for correcting the flight path ensures that the fragmentation warhead acts precisely over the mine position and thereby achieves a high fragment density.

The flight path correction by means of microreaction drive mechanisms is based on a tested technology, which allows remarkably simple implementation. With only three microreaction drive mechanisms along the periphery of the projectile, a unique flight path correction is achieved, which results in a decisive improvement in hitting accuracy.

The use of a laser for transmitting steering data to the warhead allows a simple implementation of the trigger mechanism for the fragmentation charge.

The use of the system by the crew is very simple. The soldier must only steer the laser illuminator onto the mine position and then start the neutralization. The entire further function process follows automatically.

The time duration for neutralization is minimal. The neutralization can take place about 10 seconds after the determination of the mine position. The throwing system is superbly suited for implementation as an armament kit. The construction components that need to be adapted only insignificantly change the signature of the vehicle.

Further objects, features and advantages of the present invention will become apparent from the Detailed Description of Preferred Embodiments, which follows, when considered together with the attached Figures.

BRIEF DESCRIPTION OF THE DRAWINGS

FIG. 5 is schematic illustration of the function of the throwing system.

FIG. 6 is a cross-section of the warhead with an attachment of the microreaction drive mechanisms.

FIG. 7 is a schematic illustration of the possible radial excursions of the warhead during the correction process.

DETAILED DESCRIPTION OF THE INVENTION

Figure 1:
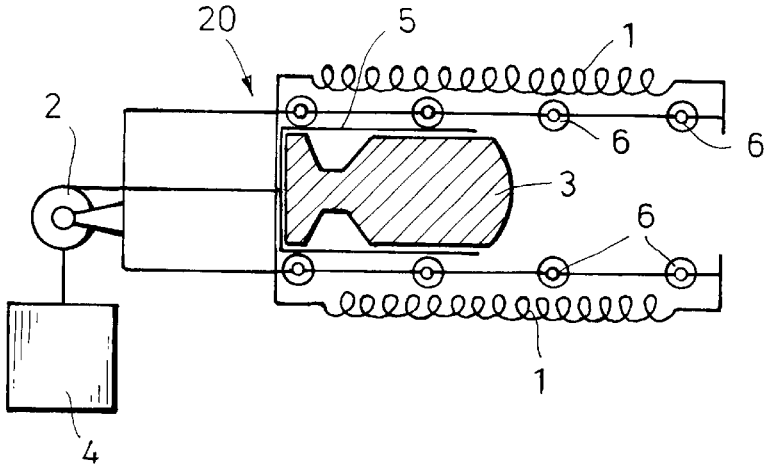
FIG. 1 is a schematic view of the throwing system.
Figure 2:
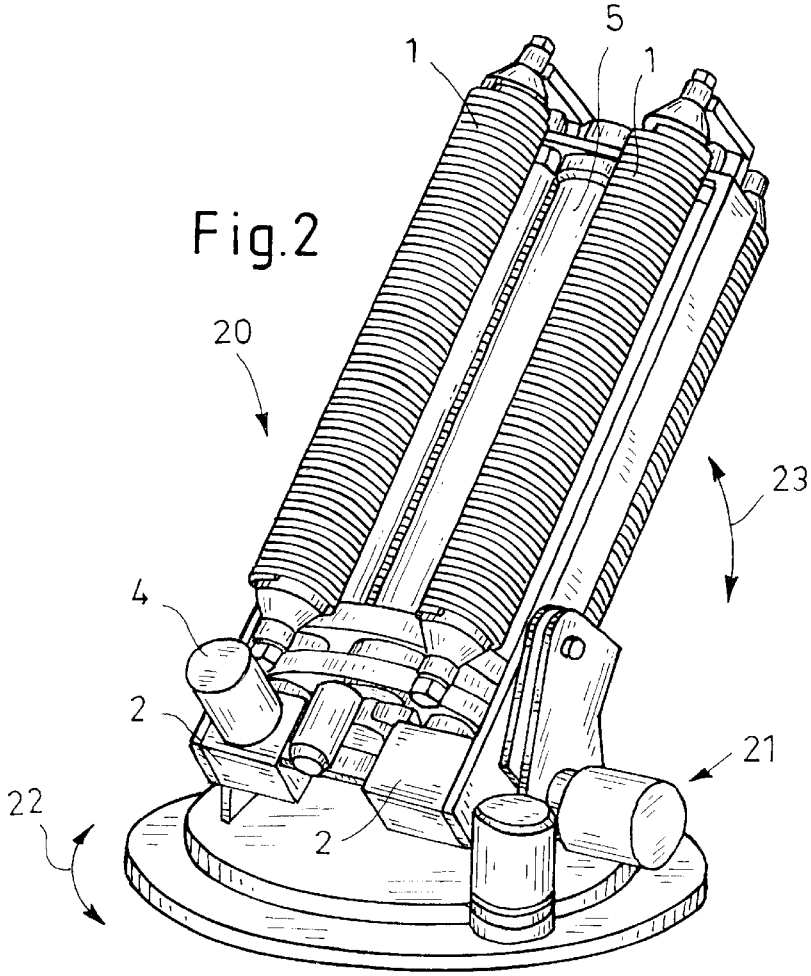
FIG. 2 is a three-dimensional view of the throwing system with a positioning device.

The throwing system according to the present invention allows the implementation of an armament kit comprising a subsystem throwing system 20 with an orientation device 21, laser illuminator 7, and fragmentation warhead 3. FIGS. 1 and 2 clearly show the throwing system 20 with orientation device 21 for precisely delivering a fragmentation warhead 3. The orientation device 21 allows the throwing system 20 to be provided with an azimuth direction 22 in the range of from 0–180 degrees and an elevation direction 23 in a range of from 60–80 degrees. A transport position of 0 degrees is also provided.

Because the typical implementation distance is between about 20 to about 100 m, the throwing system can preferably be provided as a spring throwing system, which allows a clearly smaller dispersion of the flight path compared with a pyrotechnic delivery mechanism.

The principle of the invention resides in that spring 1 is tensioned by electric motor 2 to such a degree that, when the spring is released, the fragmentation warhead 3 achieves a precise, predetermined starting speed. The force/displacement of the spring 1, which corresponds to its energy, can be measured precisely by force elements or current sensors in the power supply of the electric motors 2. In this way, even influences of temperature and material fatigue in the spring 2 can be largely compensated. Because a gas tight guidance of the fragmentation warhead 3 is not necessary, the fragmentation warhead 3 can, for example, be thrown out of a receptacle 5 with small delivery dispersion. The receptacle 5 is accelerated without play over a roller guide 6 by means of springs 1. In this embodiment, the receptacle is cup-shaped, but the invention is by no means limited to such a configuration.

Figure 3:
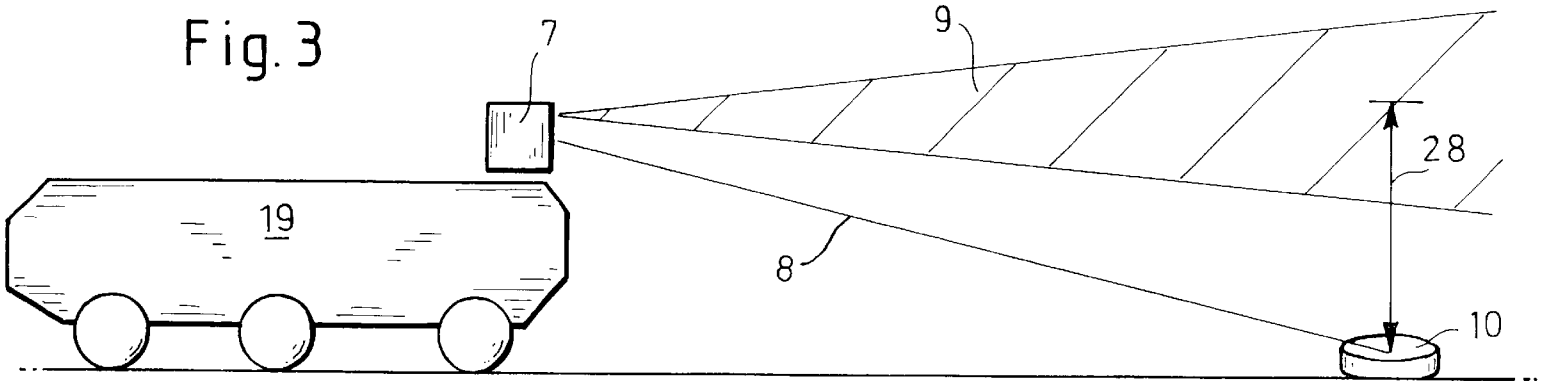
FIG. 3 is a schematic illustration of the function of a laser illuminator.
Figure 4:
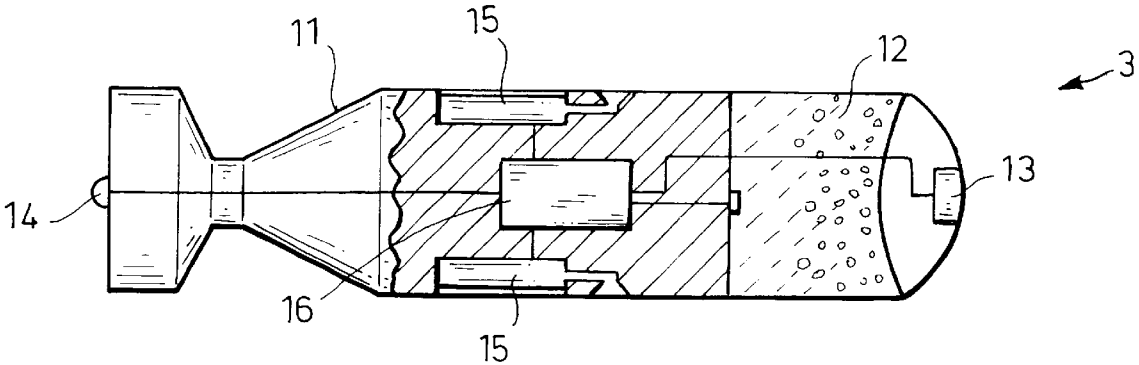
FIG. 4 is a side view of a fragmentation warhead partially in longitudinal section.

The laser illuminator 7 illustrated in FIG. 3 can send out two laser beams 8, 9 which are independently freely positionable in the azimuth and elevation, whereby the laser illuminator 7 is positioned on a vehicle 19.

The first laser beam serves to illuminate a mine 10 or a surface position under which a mine 10 is found. The laser beam 8 can be directed on a mine by means of a manual positioning of a target marker by the vehicle crew, or can be positioned automatically by a not-further-illustrated control unit. A precise position of the mine and a precise position of, as well as orientation of the vehicle 19 is necessary for this automatic control.

The second laser beam 9 takes the form of a fan. Elevation and azimuth angles are automatically given with relation to the special positioning of the illuminating laser beam 8. The azimuth angle of the center line of the fan corresponds to the azimuth angle of the illuminating laser 8, and the elevation angle is greater than the elevation angle of the illumination laser by a given value, so that the beam fan 9 progresses over the illumination position 29 of the mine 10 at a preselected distance 28, which can be, for example, 2–4 meters. The laser beam 9 is coded.

It can be seen from FIGS. 4–7 that the fragmentation warhead 3 is made of several components, as described below.

Fragmentation warhead 3 comprises a warhead body 11, a fragmentation charge 12, and a laser position detector 13 arranged on the front side of the fragmentation warhead 3. The laser position detector 13 determines the position of the laser illumination spot 29 of the illumination laser 8. The warhead 3 also has a laser detector 14 with a decoding device for detection of the coded laser fan 9, and three microreaction drive mechanisms 15 with trigger devices. The microreaction drive mechanisms 15 are disposed on the periphery of the warhead 3 at about 120 degrees. A control and computation unit 16 is also provided which controls the laser position detector 13, the laser detector 14, the microreaction drive mechanisms 15, as well as the triggering of the warhead 3.

The throwing system functions as follows.

The electronic and trigger device of the warhead 3 is activated by the throwing process. About 3 meters above the ground 24, the warhead 3 dives through the laser fan 9. This event is detected by the laser detector 14 with a decoding device. In this way the laser position detector 13 on the front side of the warhead 3 is turned on. The laser position detector 13 measures the orientation of the impact point 25 with respect to the illumination point 29. The orientation is only determined as a sector. The number of sectors is determined by the number of microreaction drive mechanisms 15. With three microreaction drive mechanisms 15 equally spaced around the periphery 17, one can, by triggering one or two drive mechanisms 15 achieve 6 excursions 18 separated by 60 degrees each. In this way a division of the search region into six orientation segments each with 60 degrees is necessary if one or two microreaction drive mechanisms are triggered, depending on the segment. The laser position detector 13 determines whether the flight path 27 ends in the spot 29 of the illumination laser 18 or whether the flight path 27 has a deviation 26. If there is a deviation 26, the angle is measured and the corresponding one or two drive mechanisms 15 are triggered. In this way, a correction of the flight path 27 in the direction of the illumination spot 10 is achieved. Because the height of the laser fan 9 over the surface of the ground, as well as the speed of the warhead are known, one can, after a predetermined time in which the correction of the flight path is made, trigger the fragmentation warhead 3 about one meter above the ground. The fragments (not shown) are thereby shot out in a nearly even distribution with a speed of about 800 m/s. The trigger height, the firing characteristics, and the number of fragments is selected so that a circle of about one meter diameter with a fragment density of from 0.2 fragments per square centimeter is achieved. The kinetic energy of the fragments is sufficient to securely destroy the mines after passing through 30 centimeters of earth.

While the present invention has been illustrated by means of several preferred embodiments, one of ordinary skill in the art will recognize that modifications, improvements, additions, deletions and substitutions can be made while remaining within the scope and spirit of the present invention, as defined by the appended claims.

We claim:

1. A system for delivering a warhead to a target region, comprising:

(a) a fragmentation warhead;

(b) a throwing system arranged to throw the fragmentation warhead to a detonation point, having a controllable energy output to achieve a preselectable starting speed;

(c) an orientation device disposed on the fragmentation warhead to correct deviation of a flight path of the fragmentation warhead before reaching the detonation point; and (d) a laser illuminator arranged to activate the orientation device, if deviation is present in the flight path of the fragmentation warhead.

2. A system according to claim 1, wherein the throwing system comprises a spring throwing system, having one or more springs, and one or more electric motors arranged to tension the springs and control the energy of the springs to achieve the preselectable starting speed.

3. A system according to claim 2, further comprising a control device for controlling tension in the springs with the electric motors.

4. A system according to claim 3, wherein the control device comprises force elements arranged to measure force in the springs.

5. A system according to claim 3, wherein the control device comprises current sensors operably connected to the power supply of the electric motors.

6. A system according to claim 1, further comprising, a first laser illuminator producing a first laser beam to illuminate a mine or surface position.

7. A system according to claim 6, wherein the first laser beam is automatically directable to a detected mine.

8. A throwing system according to claim 6, wherein the laser illuminator produces a second, coded, fan-shaped laser beam, wherein an azimuth angle of a center line of the fan is greater than an azimuth angle of the first illumination laser, and an elevation angle of thee center line of the fan is greater than an elevation angle of the illumination laser by a given value, so that the beam fan is positioned at a substantially constant preselected distance over an illumination position of the illumination laser.

9. A throwing system according to claim 7, wherein the laser illuminator produces a second, coded, fan-shaped laser beam, wherein an azimuth angle of a center line of the fan is greater than an azimuth angle of the first illumination laser, and an elevation angle of the center line of the fan is greater than an elevation angle of the illumination laser by a given value, so that the beam fan is positioned at a substantially constant preselected distance over an illumination position of the illumination laser.

10. The system according to claim 8, further comprising:

(a) a laser position detector disposed on the front side of the fragmentation warhead; and (b) a laser detector disposed on the stem side of the fragmentation warhead, having a decoding device for detecting the second, fan-shaped laser beam.

11. A system according to claim 1, further comprising:

(a) a plurality of microreaction drive mechanisms oriented evenly spaced around a periphery of the fragmentation warhead; and (b) a trigger mechanism operably connected to the microreaction drive mechanisms.

12. A system according to claim 10, further comprising:

(a) a plurality of microreaction drive mechanisms oriented evenly spaced around a periphery of the fragmentation warhead; and (b) a trigger mechanism operably connected to the microreaction drive mechanisms.

13. A system according to claims 12, further comprising, a control and drive unit disposed in the fragmentation warhead and operably connected to control the laser position detector, the laser detector, the microreaction drive mechanisms and a trigger of the warhead.

14. A system according to claims 11, comprising three microreaction drive mechanisms equally spaced around a periphery of the fragmentation warhead, said microreaction drive mechanism being triggerable singly or in pairs.

15. A system according to claims 12, comprising three microreaction drive mechanisms equally spaced around a periphery of the fragmentation warhead, said microreaction drive mechanism being triggerable singly or in pairs.

16. A method for neutralizing a mine, comprising the steps of:

(a) providing a system for delivering a warhead to a target region, comprising:

i. a fragmentation warhead;

ii. a throwing system arranged to throw the fragmentation warhead to a detonation point, having a controllable energy output to achieve a preselectable starting speed;

iii. an orientation device disposed on the fragmentation warhead to correct deviation of a flight path of the fragmentation warhead before reaching the detonation point; and iv. a laser illuminator arranged to activate the orientation device, if deviation is present in the flight path of the fragmentation warhead;

(b) illuminating a target with the laser illuminator, wherein the target includes a mine;

(c) throwing the fragmentation warhead at said preselectable starting speed toward said target; and (d) activating the orientation device, if a deviation is present in the flight path.

17. A method according to claim 16, wherein said step of throwing comprises tensioning one or more springs with one or more electric motors to achieve the preselectable starting speed.

18. A method according to claim 17, further comprising the step of controlling the tension in the springs with the electric motors.

19. A method according to claim 18, wherein said step of controlling comprises measuring a force of the springs with one or more force elements.

20. A method according to claim 18, wherein said step of controlling comprises measuring current in the power supply of the electric motors with current sensors.

21. A method according to claim 16, wherein said throwing system further comprises a receptacle operably connected to the one or more springs and configured to contain the fragmentation warhead, a roller guide arranged to slidably receive the receptacle.

22. A method according to claim 16, wherein said step of illuminating further comprises illuminating a mine or surface position with a first laser beam.

23. A method according to claim 17, wherein said step of illuminating further comprises producing a second, coded, fan-shaped laser beam, wherein an azimuth angle of a center line of the fan is greater than an azimuth angle of the first illumination laser, and an elevation angle of the center line of the fan is greater than an elevation angle of the illumination laser by a given value, so that the beam fan is positioned at a substantially constant preselected distance over an illumination position of the illumination laser.

24. A method according to claim 16, wherein said fragmentation warhead further comprises:

(a) a laser position detector disposed on a front side of the fragmentation warhead; and (b) a laser detector disposed on a stem side of the fragmentation warhead, having a decoding device for detecting the second, fan-shaped laser beam.

25. A method according to claim 23, wherein said fragmentation warhead further comprises:

(a) a laser position detector disposed on a front side of the fragmentation warhead; and (b) a laser detector disposed on a stem side of the fragmentation warhead, having a decoding device for detecting the second, fan-shaped laser beam.

26. A method according to claim 16, wherein said step of activating the orientation device comprises triggering one or more of three microrection drive mechanisms positioned equally spaced about a periphery of the fragmentation warhead.

27. A method according to claim 23, wherein said step of activating the orientation device comprises triggering one or more of three microreaction drive mechanisms positioned equally spaced about a periphery of the fragmentation warhead.

28. A method according to claim 25, wherein said step of activating the orientation device comprises triggering one or more of three microreaction drive mechanisms positioned equally spaced about a periphery of the fragmentation warhead.

29. A system for delivering a warhead to a target region, comprising:

(a) a fragmentation warhead;

(b) a throwing system arranged to throw the fragmentation warhead to a detonation point, having a controllable energy output to achieve a preselectable starting speed, wherein the throwing system comprises:

i. a spring throwing system, having one or more springs, and one or more electric motors arranged to tension the springs and control the energy of the springs to achieve the preselectable starting speed;

ii. a receptacle operably connected to the one or more springs and configured to contain the fragmentation warhead; and iii. a roller guide arranged to slidably receive the receptacle;

(c) an orientation device disposed on the fragmentation warhead to correct deviation of a flight path of the fragmentation warhead before reaching the detonation point; and (d) a laser illuminator arranged to activate the orientation device, if deviation is present in the flight path of the fragmentation warhead.

30. A system as recited in claim 1, wherein the throwing system, the orientation device, the laser illuminator and the fragmentation warhead provide an armament kit positioned on a vehicle.

* * * * *